United States Patent [19]

Piretti

[11] Patent Number: 4,915,449

[45] Date of Patent: Apr. 10, 1990

[54] CHAIR WITH A PIVOTING SEAT

[75] Inventor: Giancarlo Piretti, Bologna, Italy

[73] Assignee: Pro-Cord S.r.l., Bologna, Italy

[21] Appl. No.: 348,705

[22] Filed: May 8, 1989

[30] Foreign Application Priority Data

May 18, 1988 [IT] Italy ..... 67463 A/88

[51] Int. Cl.[4] ..... A47C 1/02

[52] U.S. Cl. ..... 297/326; 297/301

[58] Field of Search ..... 297/326, 327, 328, 270, 297/300, 301, 302, 303; 108/1, 8; 248/271, 398

[56] References Cited

U.S. PATENT DOCUMENTS

| | | | |
|---|---|---|---|
| 2,633,897 | 4/1963 | Moore | 297/326 X |
| 4,438,978 | 3/1984 | Arild | 297/301 |
| 4,720,142 | 1/1988 | Holdredge | 297/302 X |
| 4,763,950 | 8/1988 | Tobler | 297/301 |

*Primary Examiner*—James T. McCall

*Attorney, Agent, or Firm*—Fuller, Ryan & Hohenfeldt

[57] ABSTRACT

A chair comprises a base structure, a seat mounted on the base structure for pivoting about a transverse axis, travel limiting means which define the position of maximum rearward pivoting and the position of maximum forward pivoting of the seat, and resilient means which bias the seat towards its position of maximum rearward pivoting. The travel limiting means enable at least one of the end-of-travel positions to be adjusted.

9 Claims, 7 Drawing Sheets

CHAIR WITH A PIVOTING SEAT

The present invention relates to a chair of the type comprising:

a base structure, a seat mounted on the base structure for pivoting about a transverse axis, travel limiting means which define the position of maximum rearward pivoting and the position of maximum forward pivoting of the seat, and resilient means which bias the seat towards its position of maximum rearward pivoting.

The object of the present invention is to produce a chair of the type indicated above which can be adapted to various possible requirements of the user and which at the same time has a simple and reliable structure.

According to the present invention, this object is achieved by virtue of the fact that the travel limiting means enable at least one of the end-of-travel positions to be adjusted.

In a first embodiment the travel limiting means comprise a cam mounted on the seat for rotation about a transverse axis and adapted to abut an element fixed to the base structure of the chair in the position of maximum rearward pivoting of the seat, means being provided for adjusting the angular position of the cam relative to its axis. The means for adjusting the angular position of the cam comprise a shaft to which the cam is fixed and which is mounted on the seat for rotation about the transverse axis, and an adjustment knob fixed to one end of the shaft.

In a second embodiment, the travel limiting means comprise a wedge which is mounted for sliding on a transverse pin fixed to the seat and is adapted to abut an element fixed to the base structure of the chair in the position of maximum rearward pivoting of the seat, the element having an inclined surface with an inclination which corresponds to that of the inclined surface of the wedge, means being provided for adjusting the axial position of the wedge relative to the pin. The means for adjusting the axial position of the wedge comprise an elongate member fixed at one end to the wedge and having an adjustment knob at its other end.

Figure 1:
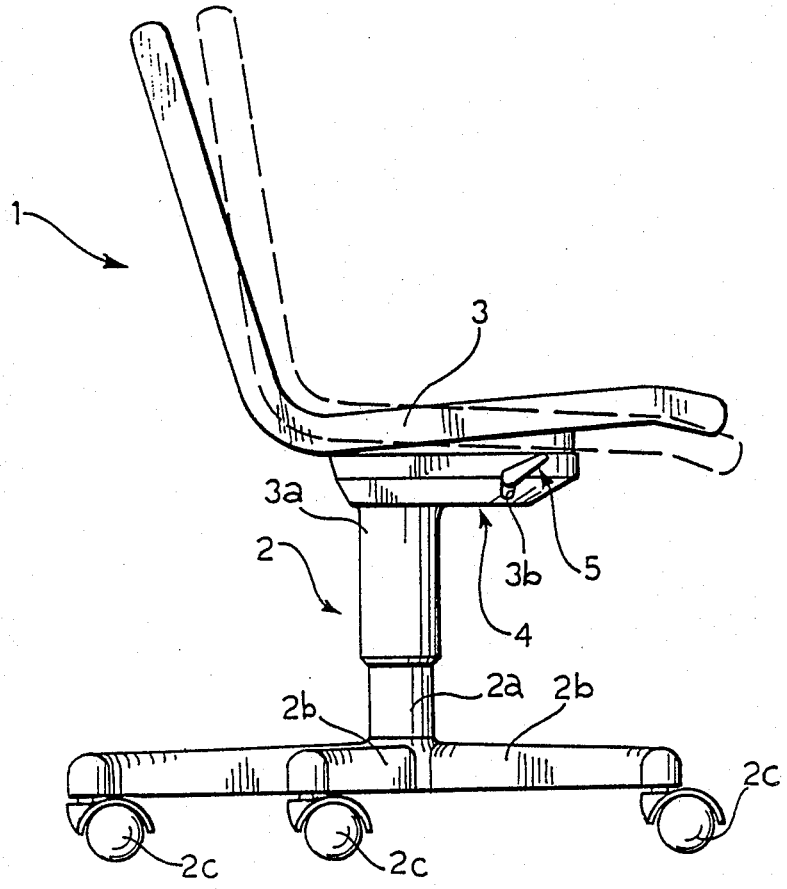
Figure 2:
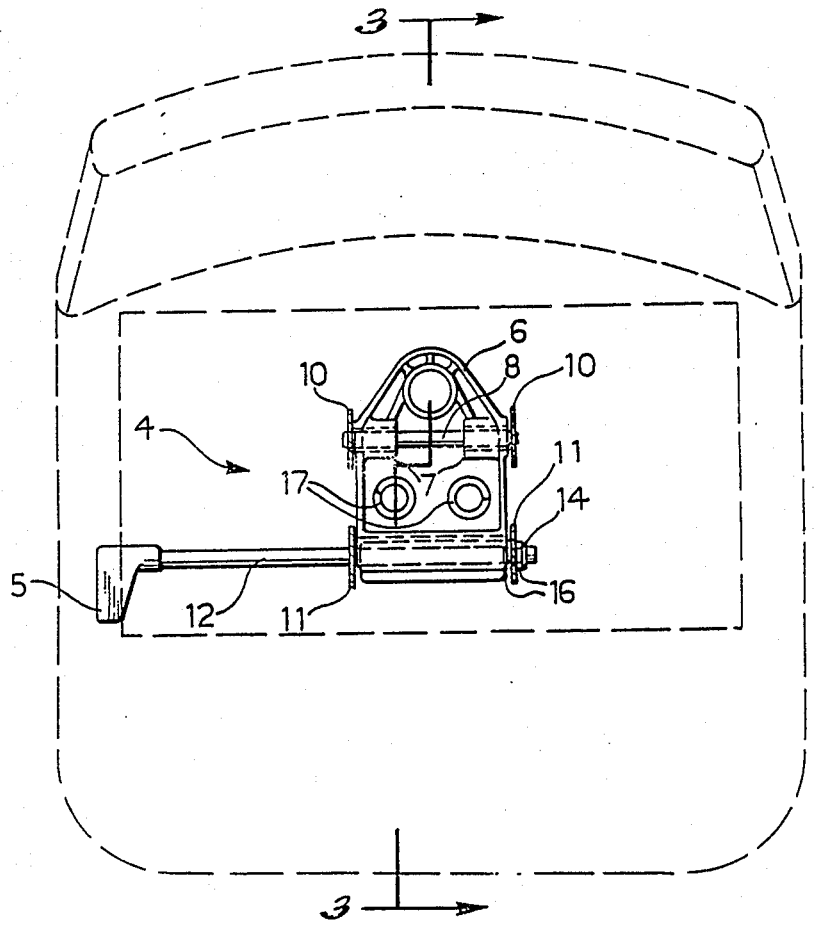
Figure 3:
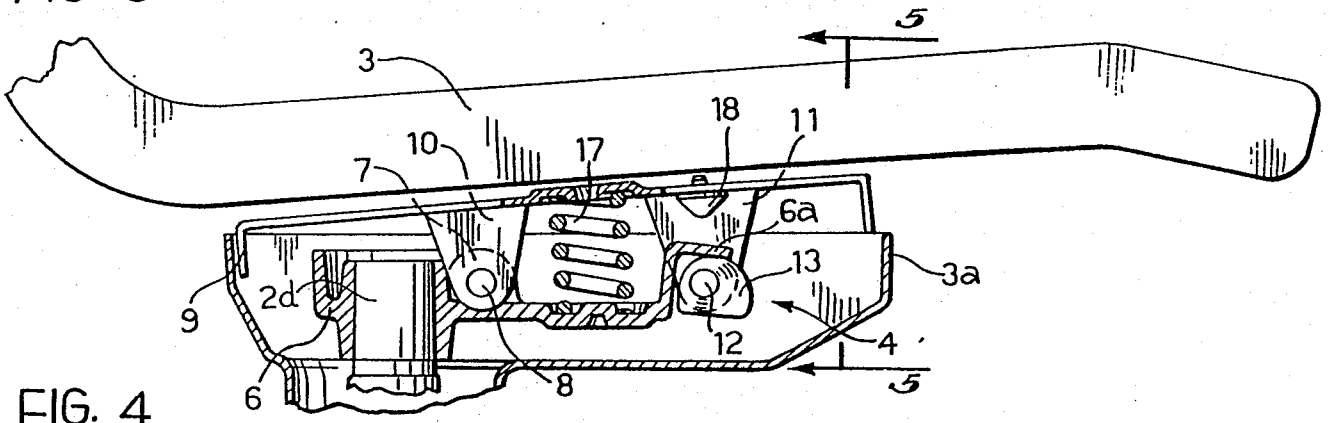
Figure 4:
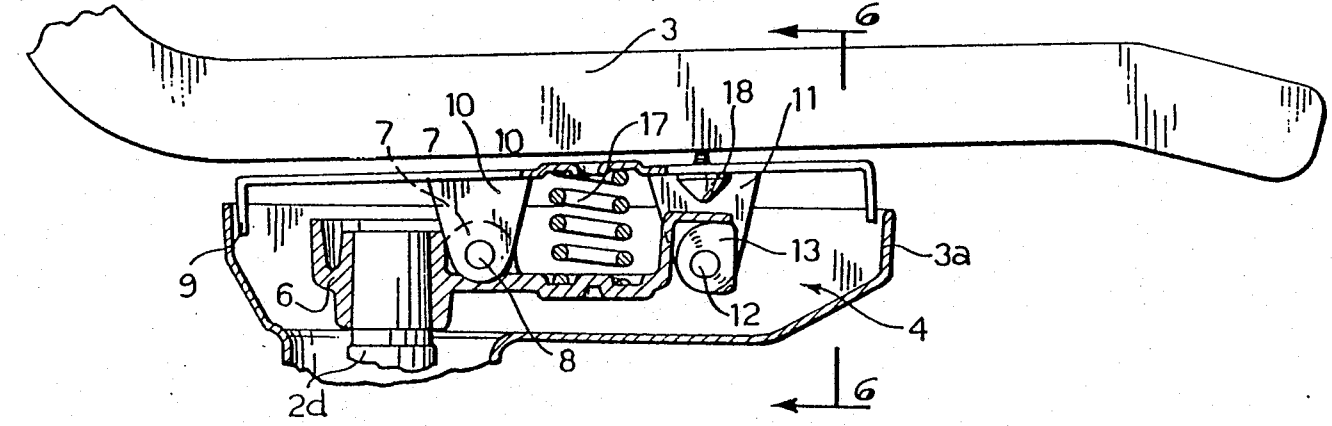
Figure 5:
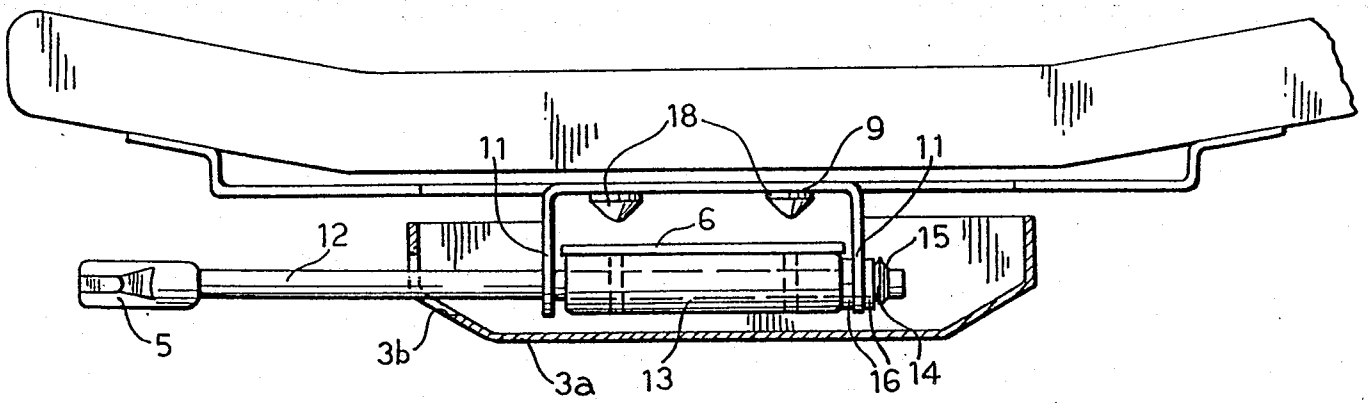
Figure 6:
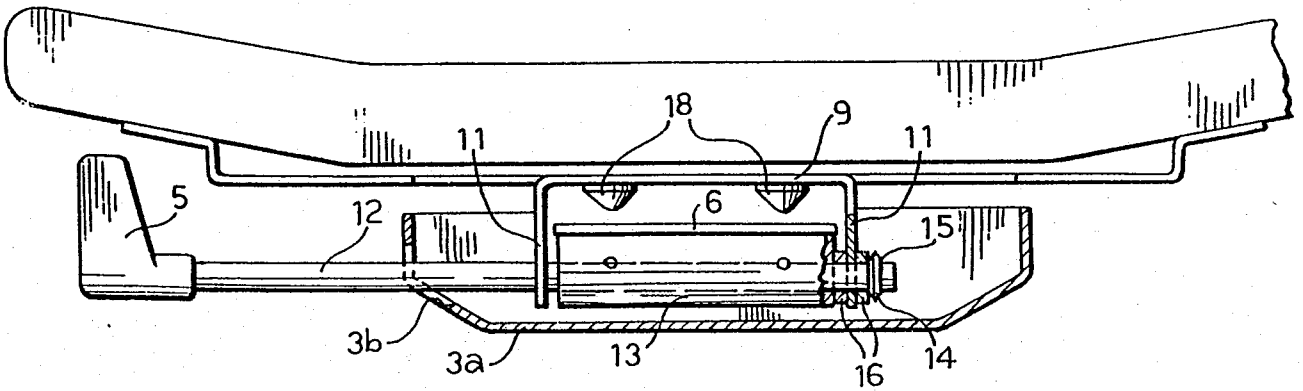

Further characteristics and advantages of the present invention will become clear from the detailed description which follows with reference to the appended drawings, provided purely by way of non-limiting example, in which:

FIG. 1 is a schematic side elevational view of a chair according to the present invention, FIG. 2 is a plan view of the support for the seat of a chair according to a first embodiment of the invention (the body of the chair being shown in broken outline), FIGS. 3 and 4 are sections taken on the line III—III of FIG. 2 with the seat in the conditions of its maximum and minimum degrees of pivoting, respectively, FIGS. 5 and 6 are sections taken on the lines V—V and VI—VI of FIGS. 3 and 4.

Figure 7:
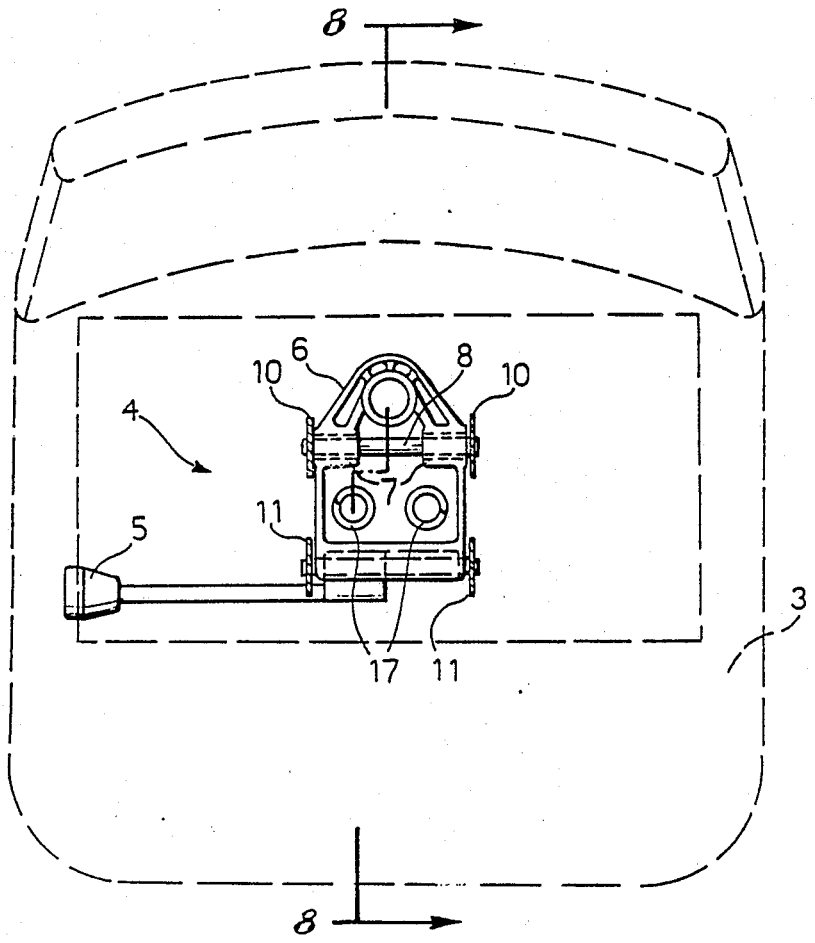
Figure 8:
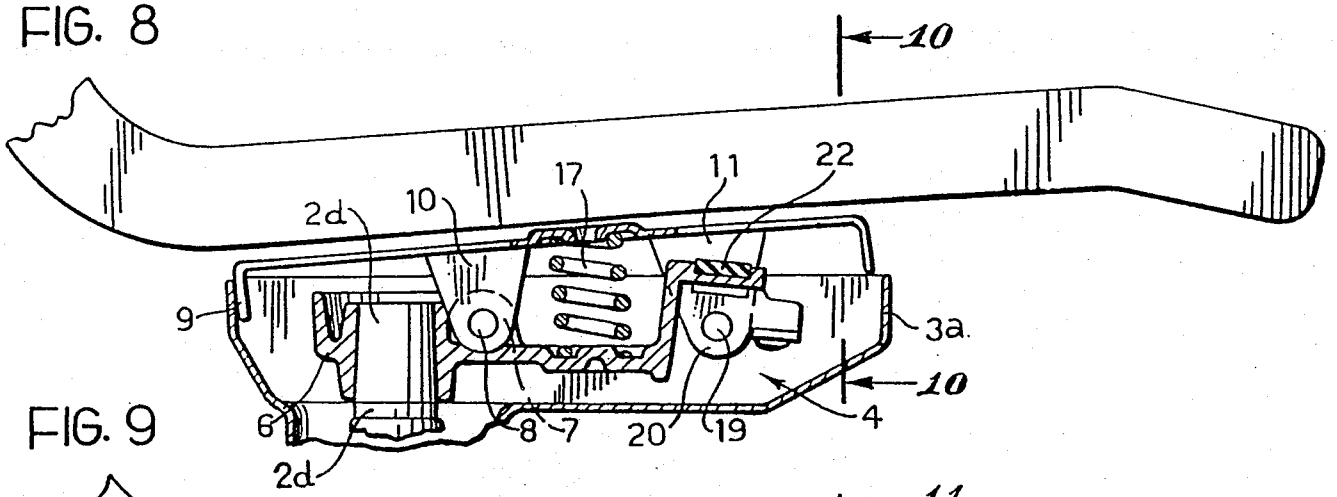
Figure 9:
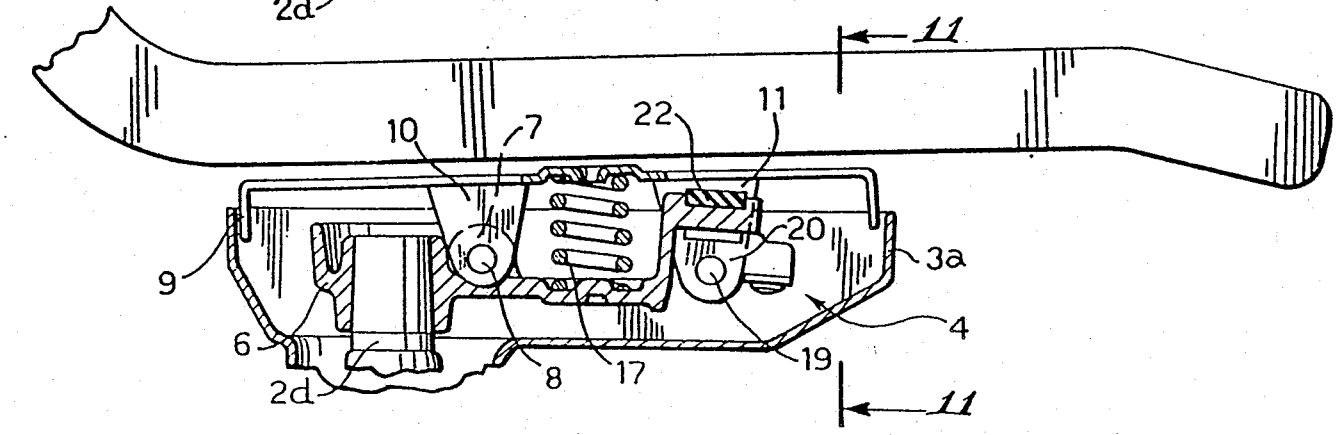
Figure 10:
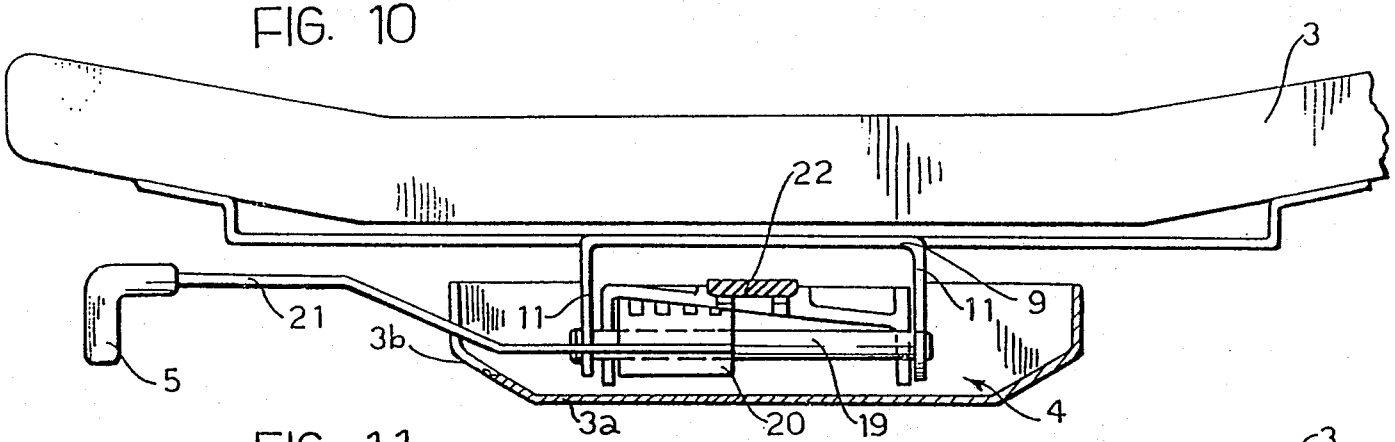
Figure 11:
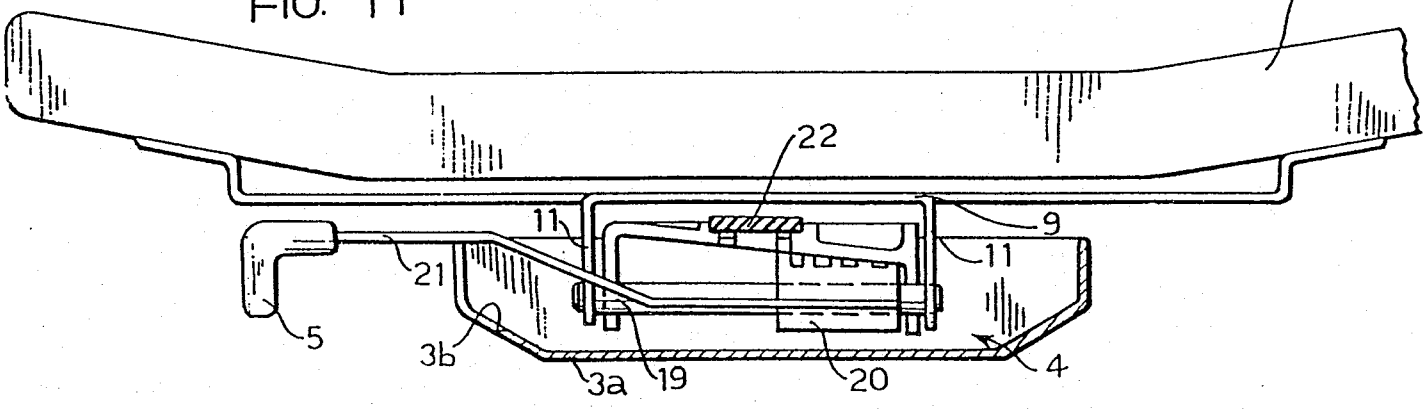

FIG. 7 shows a variant of FIG. 2 which corresponds to a second embodiment of the invention, FIGS. 8 and 9 are sections taken on the line VIII—VIII of FIG. 7 with the seat in the conditions of its maximum and minimum degrees of pivoting, respectively, and FIGS. 10 and 11 are sections taken on the lines X—X and XI—XI of FIGS. 8 and 9.

In FIG. 1, an office chair is indicated 1 and comprises a base structure 2 and a seat 3 supported by the base structure 2 for pivoting about a transverse axis, as will be described in more detail below. In FIG. 1, the positions of maximum rearward and forward pivoting of the seat are shown in continuous outline and broken outline respectively. In use, the seated person adopts any seat position between the two extreme positions, in dependence on his particular requirements. In general, for example, a more forwardly-inclined seat position lends itself better to the operation of keyboards or the like, whilst the most rearwardly inclined position enables greater relaxation.

The drawing relates to a case in which the base structure 2 is of the known type including a central pillar 2*a* (preferably of adjustable length) which has spokes 2*b* with castors 2*c* at the bottom. However, the present invention is adaptable to any other type of base structure, for example, to a structure constituted by four supporting legs which are joined at the top to form a base for a central support.

A device 4 for adjusting the degree of pivoting is provided between the base structure 2 and the pivoting seat 3, and includes an adjustment knob 5. The base structure 2 includes a casing 3*a* fixed to the central pillar 2*a* and having a lower cylindrical part which surrounds the upper part of the pillar 2*a* as well as the rod 2*d* of the cylinder which is enclosed by the pillar 2*a* and serves for the adjustment of the height of the seat. The casing 3*a* has an upper part which encloses the adjustment device 4 and has a slot 3*b* from which the adjustment knob 5 projects.

In the first embodiment shown in FIGS. 2 to 6, a support 6 is fixed to the upper end of the central pillar 2*a* of the chair. The support 6 has two lugs 7 in which a pin 8 is mounted.

A plate 9 is fixed to the lower part of the seat 3 and has a first pair of flanges 10. The flanges 10 engage the free ends of the pin 8 and articulate the seat 3 to the base structure 2 of the chair. The plate 9 has a second pair of flanges 11 which support a shaft 12 for rotation. A cam 13 is fixed to the shaft 12 by means of transverse screws and is situated between the two flanges 11. The cam 13 faces the bottom of a shaped end 6*a* of the support 6. The plate 9 carries a pair of resilient buffers 18 facing the top of the shaped end 6*a*. A split ring 15 which constitutes a bearing surface for two Belleville washers 14 is mounted at the other end of the shaft 12. The washers 14 exert a small longitudinal force which urges two spacers 16 against the lateral surfaces of the flange 11 so as to generate a slight friction which prevents the unwanted rotation of the shaft 12. Two helical springs 17 are arranged under comPression between the support 6 and the plate 9 and exert an upward force on the seat 3. In the absence of other forces applied to the seat 3, the springs 17 keep the cam 13 in abutment with the shaped end 6*a* of the support 6 and therefore keep the seat in the position of maximum rearward pivoting.

If a force is exerted on the front part of the seat 3, the seat pivots about the articulation pin 8 until the resilient buffers 18 abut the shaped end 6*a* of the support 6. It is possible, by the rotation of the cam 13 by means of the knob 5 and the shaft 12, to vary the position of maximum rearward pivoting of the seat 3 between the condition of maximum travel, shown in FIGS. 3 and 5, and the condition of minimum travel, shown in FIGS. 4 and 6.

A second embodiment is shown in FIGS. 7 to 11, in which parts identical or similar to those already described are indicated by the same reference numerals. A transverse pin 19 is fixed to the flanges 11 and a wedge 20 is slidably mounted thereon. An elongate member 21 is fixed at one end to the wedge 20 and has an adjustment knob 5 fixed to its other end. The wedge 20 faces the lower surface of the shaped end 6*a* of the support 6, the surface having an inclination which corresponds to that of the inclined surface of the wedge 20. A resilient buffer 22 is situated on the upper surface of the shaped end 6*a*.

Like the cam 13 in the embodiment described above, the wedge 20 represents travel limiting means which define the position of maximum rearward pivoting of the seat 3. The axial displacement of the knob 5 varies the axial position of the wedge 20 in relation to the inclined surface of the shaped end 6*a* and it is therefore possible to adjust the position of maximum rearward pivoting of the seat between a condition of maximum travel, shown in FIGS 8 and 10, and a condition of minimum travel, shown in FIGS 9 and 11.

I claim:

1. A chair comprising:

a base structure, a seat mounted on the base structure for pivoting about a transverse axis, travel limiting means which define a position of maximum rearward pivoting of the seat and a position of maximum forward pivoting of the seat, and resilient means which bias the seat towards its position of maximum rearward pivoting, wherein the travel limiting means enable at least one of the end-of-travel positions to be adjusted.

2. A chair according to claim 1, wherein the travel limiting means comprise a cam mounted on the seat for rotation about a transverse axis, an element fixed to the base structure of the chair for abutment by the cam in the position of maximum rearward pivoting of the seat, and means for adjusting the angular position of the cam relative to its axis.

3. A chair according to claim 2, wherein the means for adjusting the angular position of the cam comprise a shaft to which the cam is fixed and which is mounted on the seat for rotation about the transverse axis, and an adjustment knob fixed to one end of the shaft.

4. A chair according to claim 1, wherein the travel limiting means comprise a transverse pin fixed to the seat, a wedge mounted for sliding on the pin, an element fixed to the base structure of the chair for abutment by the wedge in the position of maximum rearward pivoting of the seat, the element having an inclined surface with an inclination which corresponds to that of the inclined surface of the wedge, and means for adjusting the axial position of the wedge relative to the pin.

5. A chair according to claim 4, wherein the means for adjusting the axial position of the wedge comprise an elongate member fixed at one end to the wedge and an adjustment knob fixed to the other end of the elongate member.

6. A chair comprising:

a base structure;

a seat mounted on the base structure for pivoting about a transverse axis;

travel limiting means which define a position of maximum rearward pivoting of the seat and the position of maximum forward pivoting of the seat; and resilient means which bias the seat towards its position of maximum rearward pivoting;

said travel limiting means including means for adjusting at least one of the end-of-travel positions;

said travel limiting means further comprising a cam mounted on the seat for rotation about a transverse axis, an element fixed to the base structure of the chair for abutment by the cam in the position of maximum rearward pivoting of the seat, and means for adjusting the angular position of the cam relative to its axis.

7. A chair according to claim 6 wherein the means for adjusting the angular position of the cam comprise a shaft to which the cam is fixed and which is mounted on the seat for rotation about the transverse axis, and an adjustment knob fixed to one end of the shaft.

8. A chair comprising:

a base structure;

a seat mounted on the base structure for pivoting about a transverse axis;

travel limiting means which define a position of maximum rearward pivoting of the seat and the position of maximum forward pivoting of the seat; and resilient means which bias the seat towards its position of maximum rearward pivoting;

said travel limiting means including means for adjusting at least one of the end-of-travel positions;

said travel limiting means further comprising a transverse pin fixed to the seat, a wedge mounted for sliding on the pin, an element fixed to the base structure of the chair for abutment by the wedge in the position of maximum rearward pivoting of the seat, the element having an inclined surface with an inclination which corresponds to that of the inclined surface of the wedge, and means for adjusting the axial position of the wedge relative to the pin.

9. A chair according to claim 8, wherein the means for adjusting the axial position of the wedge comprise an elongate member extend one end of the wedge and an adjustment knob fixed to the other end of the elongate member.

* * * * *